US006513676B2

(12) United States Patent
Clemmons

(10) Patent No.: US 6,513,676 B2
(45) Date of Patent: Feb. 4, 2003

(54) UNIVERSAL CUP HOLDER WITH FOOD TRAY ACCESSORIES

(76) Inventor: Martin L. Clemmons, 18475 Fox Ford Rd., Bay Minette, AL (US) 36507

( * ) Notice: Subject to any disclaimer, the term of this patent is extended or adjusted under 35 U.S.C. 154(b) by 0 days.

(21) Appl. No.: 09/872,601

(22) Filed: Jun. 1, 2001

(65) Prior Publication Data

US 2002/0011495 A1 Jan. 31, 2002

Related U.S. Application Data

(60) Provisional application No. 60/212,958, filed on Jun. 21, 2000.

(51) Int. Cl.[7] ..... A47G 29/00
(52) U.S. Cl. ..... 220/737; 220/23.83; 220/23.86
(58) Field of Search ..... 220/737, 23.83, 220/23.86, 480; 211/86, 88; 248/230.1

(56) References Cited

U.S. PATENT DOCUMENTS

| | | | | | |
|---|---|---|---|---|---|
| 4,836,403 | A | * | 6/1989 | Blackman | 220/23.83 X |
| 4,927,024 | A | * | 5/1990 | Lloyd | 220/23.86 X |
| 4,928,876 | A | * | 5/1990 | Marshall | 220/737 X |
| 4,989,742 | A | * | 2/1991 | Powell | 220/737 X |
| 5,119,967 | A | * | 6/1992 | Ercolani | 220/737 X |
| 5,607,077 | A | * | 3/1997 | Torkelson | 220/737 X |
| 5,860,559 | A | * | 1/1999 | Wang | 220/737 |

* cited by examiner

*Primary Examiner*—Steven Pollard

(57) ABSTRACT

A tray is described which has a corner having an angle where the tray is attachable to 1) a holding bracket which may be attached to the corner defining at least one top chamber; 2) a tray having a tray bottom chamber removably insertable within the top chamber said tray having an indented portion having an angle corresponding approximately to the angle of the corner and around the corner when the tray is placed within the top chamber; and 3) at least one cup holder located on top of the tray capable of holding a drink container of a given diameter, and at least one insert having a first end and a second end fitting within the at least one cup holder capable of holding at least one second drink container of a lesser given diameter. The holding bracket further comprises at least bottom elastic holding partially opened arc shaped arm for holding the insert elastically along the outer diameter of the insert. The insert has one internal diameter when inserted at the first end and a second internal diameter at the second end so that it may hold drinks of different sizes depending on which side is inserted. There is also be a cup having the same diameter as the insert so that it may be held in either the arm or the at least one cup holder. There may be a clip located below the surface and approximately at the perimeter of the tray for holding an end of a closed or open bag container. A second holder having,a low wall so that a low walled dip container may be held may be in place on the tray top. Preferably, there is a perimeter wall for preventing movement off the tray of times within the tray.

19 Claims, 5 Drawing Sheets

UNIVERSAL CUP HOLDER WITH FOOD TRAY ACCESSORIES

PRIORITY

This patent claims priority based on and is a continuation of Provisional Patent Serial No. 60/212,958 filed Jun. 21$^{st}$, 2000.

BACKGROUND OF INVENTION

1. Field of Invention

The invention applies to trays. More particularly the invention pertains to trays attachable around a corner in a vehicle.

2. Prior Art

Trays for vehicles are known in the prior art.

GENERAL DISCUSSION OF THE INVENTION

The invention is a cup holder which may fit into a corner having a corner angle. The invention comprises: 1) a holding bracket attached to the corner defining at least one top cylinder; 2) a tray having a tray bottom cylinder removably insertable within the top cylinder. The tray has an indented portion having an angle corresponding approximately to the angle of the corner. This indented portion of the tray may be designed to fit around the corner when the tray is placed within the top cylinder. There is at least one cup holder located on top of the tray capable of holding a drink container of a given diameter. In the preferred embodiment, in order to accommodate different sized drink holders, there is at least one insert having a first end and a second end. This insert fits within at least one cup holder and has a smaller diameter at the second end than the diameter of the first end so that it is capable of holding different sized drink containers of different diameters depending on which end is inserted.

The holding bracket in the preferred embodiment, also comprises at least bottom elastic, partially opened arm, in the shape of an open arc for holding, interchangeable, the insert of a cup. The arm does this by elastically gripping the insert or cup along the outer circumference of the insert or cup. The insert has one internal diameter when inserted at the first end and a second internal diameter at the second end so that it may hold drinks of different sizes depending on which side is inserted.

The internal circumference of the insert on one side may be square shaped to hold a square drink container. There may also be a cup having the same diameter as the insert so that the cup may be held in either the arm or at least one cup holder. There may be a clip located below the tray surface and approximately at the perimeter of the tray for holding an end of a closed or open bag. The perimeter has a raised lip 30 to prevent items from sliding off of the tray.

A second holder having a low wall is provided so that a low walled dip container may be held in place on the tray top within the second holder. The perimeter wall is to prevent movement off the tray of items placed on the surface of the tray and the holders are within this perimeter so that spills from drinks or dips remain on the tray for easy clean up.

The invention is, therefore, a tray designed for use, particularly with a square surface such a vehicle having a corner or a desk having a corner. The invention comprises two parts: 1) a tray designed to fit on a corner but still be wide enough in order to accommodate a take out container of food and 2) a universal cup holder arrangement or a tray and cooperating drink holders.

It is a purpose of the invention to provide for a tray for holding drinks and food for a vehicle operator or the passenger for the types of foods typically consumed by a traveling consumer.

It is another purpose of the invention to provide a tray which allows for various sized drink holders to be held.

It is another purpose to provide a bracket which can hold, alternatively, drinks or trays.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE PREFERRED EXEMPLARY EMBODIMENTS

Figure 2:
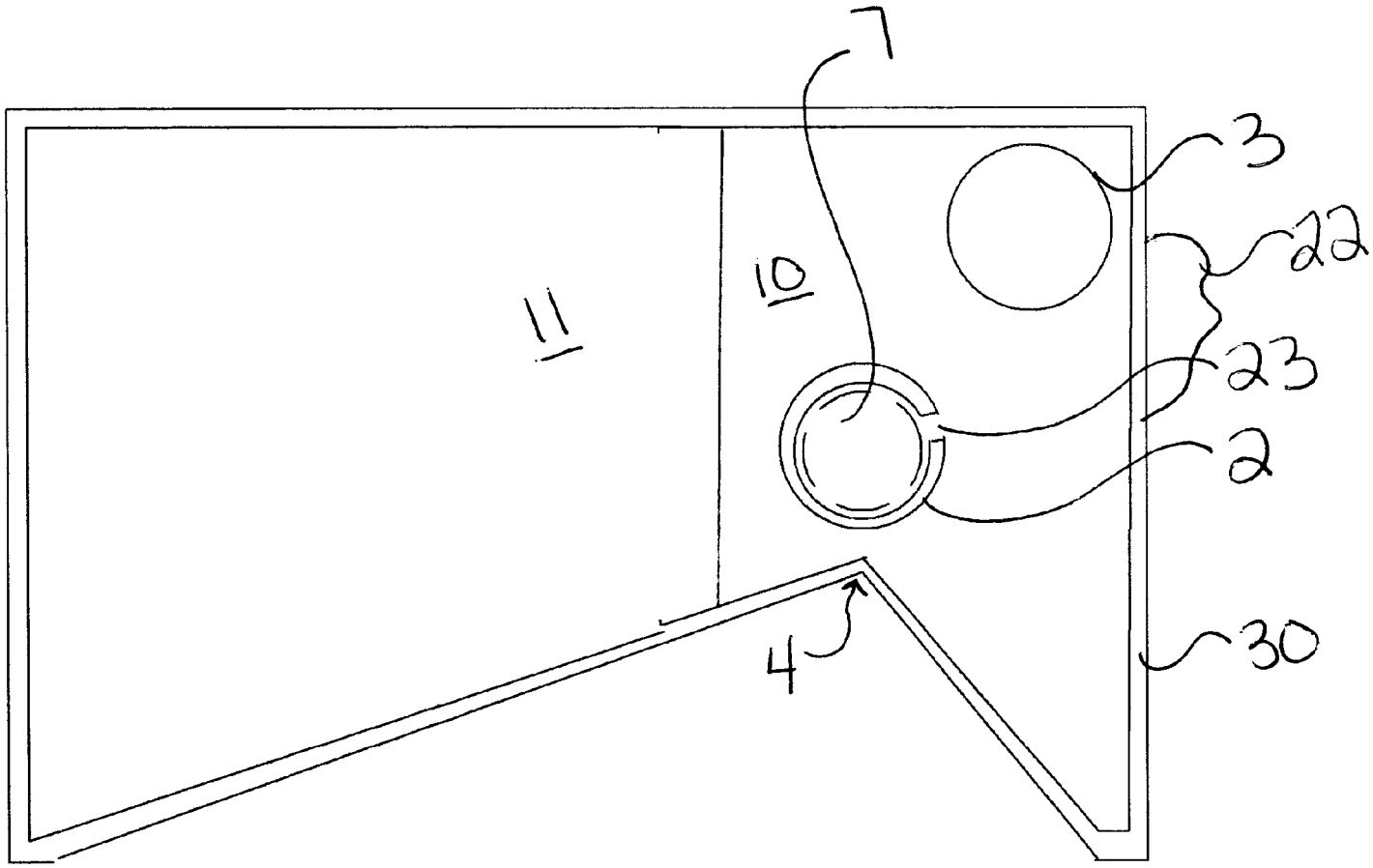
FIG. 2 is a top view of the tray holder.

As can best be seen by reference to FIG. 2 the tray 1 has a raised cup holder 2 and a lower cup holder 3. The exact dimensions of the raised cup holder and lower cup holder will be better understood from the description which follows.

In the preferred embodiment the raised cup holder 2 has a reduced circumference bottom 7 so that the circumference above the reduced circumference bottom 7 has a top perimeter capable of holding a standard twelve once insulated cup which has a diameter of approximately 2⅞ inches. Preferably the twelve once insulated cup also has a bottom which is the same size or smaller than a twelve once can which is approximately the diameter of the reduced circumference bottom 7 of the raised cup holder 2.

The lower cup holder 3 has the same appropriate circumference (preferably 9.036 inches) as the raised cup holder 2.

The tray defines a bend 4 of approximately 90 degrees as will be described in more detail below.

Figure 1:
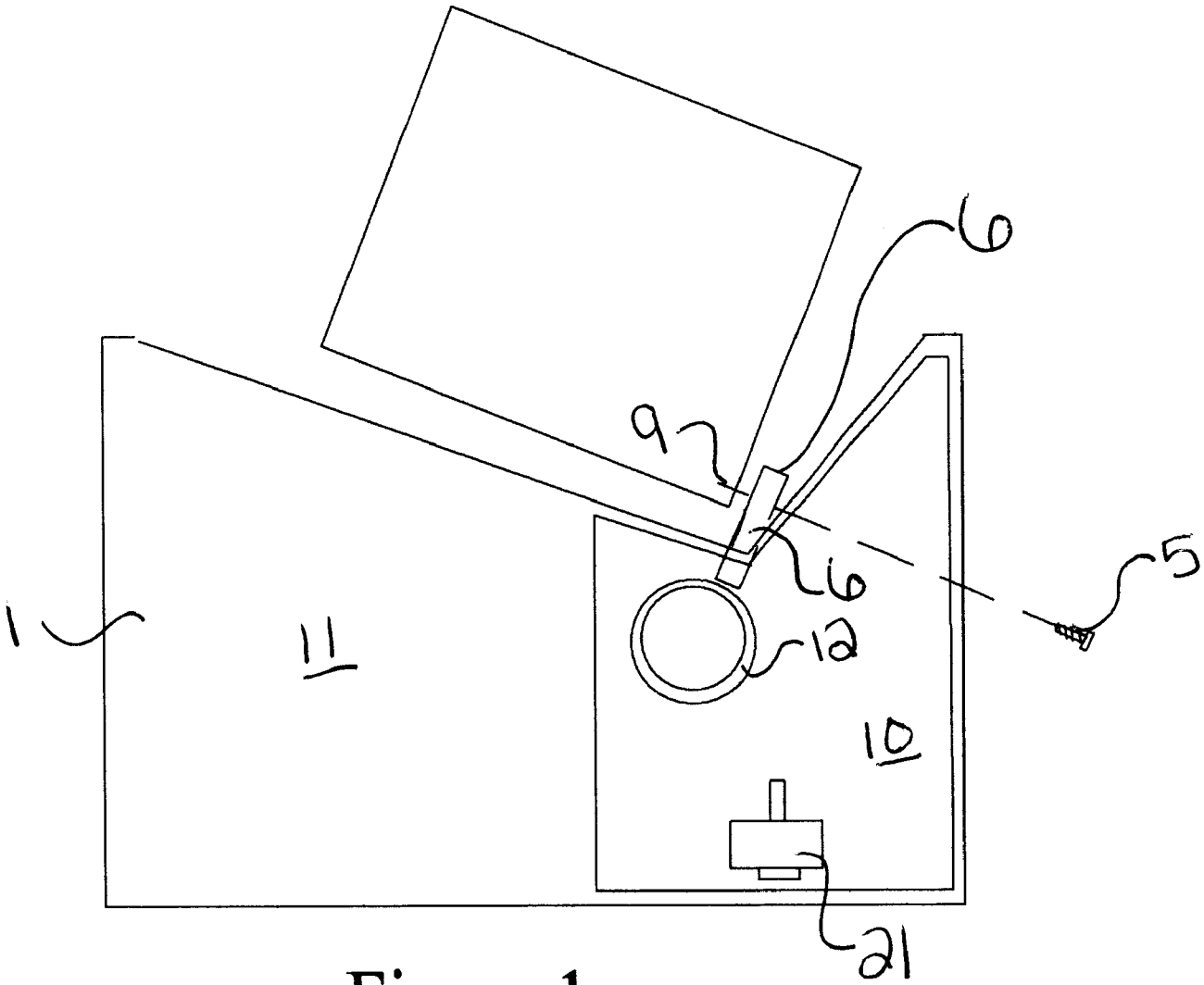
FIG. 1 is a bottom view of the tray holder.

The purpose of this bend 4, as seen in FIG. 1, is to allow a bracket 6 on which the tray 1 sits to be bolted by a bolt 5 into the corner 9 of the dashboard or desk or similar squared object to which the tray is attached. The peg 12 is insertable into and held snugly by the receiving holder 13 which has the same diameter as insulated cup 17. In this way, the entire tray 1 or just the insulated cup 17 may be held in the receiving holder 13 depending on the need of the user. The tray 1 has a reduced section 10 and an expanded section 11 to provide drinks in close proximity to the user but to have a tray adjacent for any items.

Figure 3:
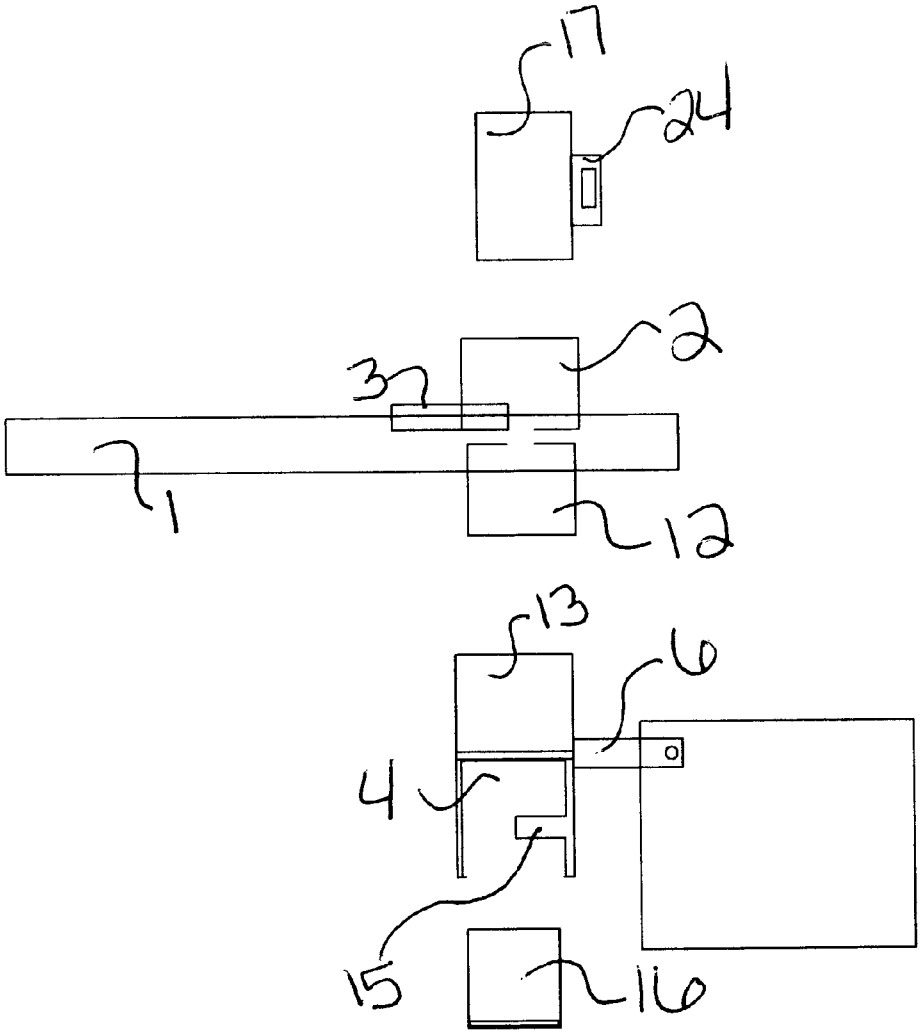
FIG. 3 is a side view of the tray holder.

As can best be seen by the side view shown in FIG. 3 directly below the raised cup holder 2 is an insertion peg 12. This pet 12 is slightly smaller, in the preferred embodiment, in i diameter than the outside diameter of the raised cup holder 2. In order to hold the tray 1 up, the bracket 6 is attached to the receiving holder 13. Below the receiving holder 13 is a partially open flexible arm 15 defining a containment area 14 which can hold an adaptor 16 which is approximately the same size as the twelve ounce insulated cup 17. In this way, either the cup 17 or the adaptor 16 may be removably held underneath the bottom of the tray 1 utilizing the flexible arm 15 to grip them.

The adaptor 16 has a top inner circumference 18 and a reduced lower inner circumference 19. The top inner circumference 18 is the correct size for a standard, cylindrical, twelve to twenty once cup. On the opposite end, a reduced lower inner circumference 19 is the same size as the twelve ounce drink can. This adaptor 16 may be insulated in order to maintain the temperature of the drink held.

On the bottom side of the tray 1 as shown in FIG. 1 there is a clip 21 which can hold a bag 22 of chips. The lower cup holder 3 can hold a dip for the chips held by the clip 21. The clip 21 is on the outer edge of the reduced section 10 of the tray 1 so that the chips may be opened below the holder as shown with the chip bag 22 in FIG. 2.

There is an opening or break 23 in the raised cup holder 3 in order to allow a handle 24 of the cup 17 to be placed and held securely in the raised cup holder 2.

The direction which the opening 23 faces is such that it is most convenient for the user. The raised cup holder 2 may be able to turn about its center in order to change the location of the opening 23 relative to the user. All of the can or cup holders may be insulated.

Figure 4:
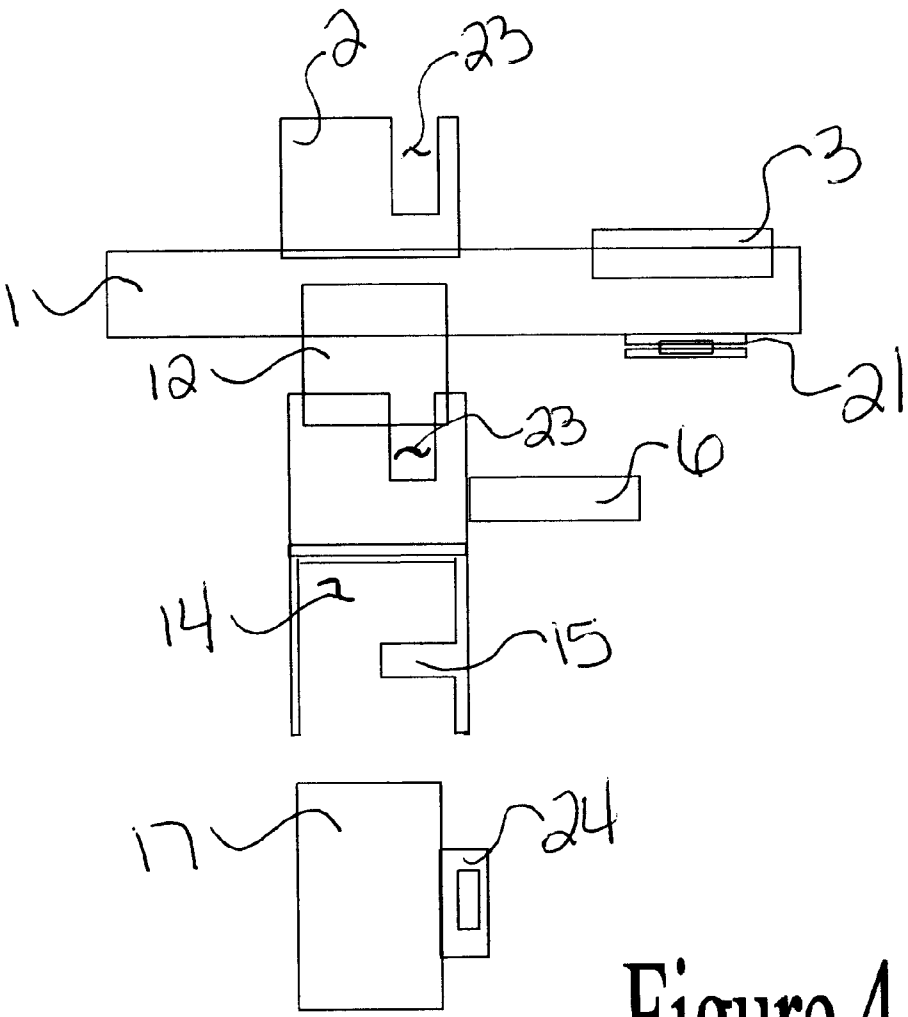
FIG. 4 is an alternate side view of the tray holder.
Figure 5:
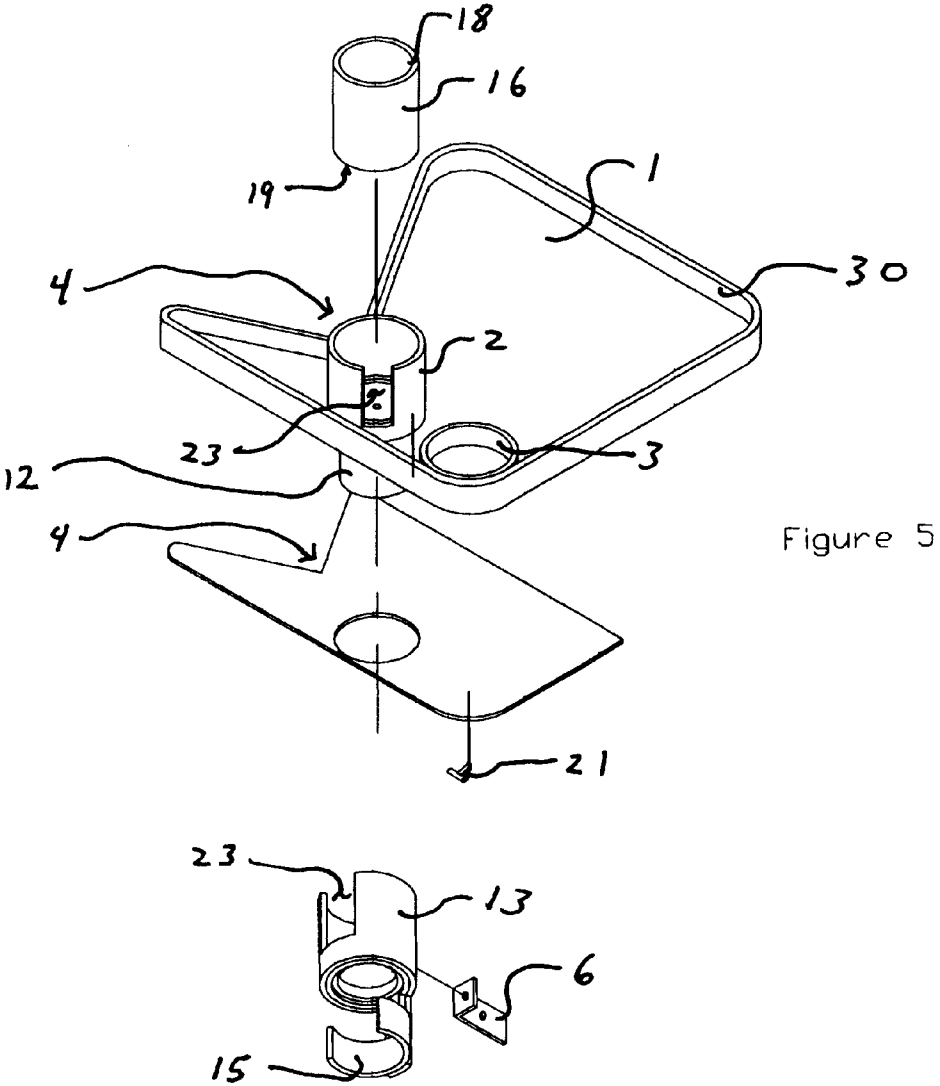
FIG. 5 is a perspective view of the preferred embodiment.

As can be seen by reference to FIG. 4, the cup 17 has a handle 24 along the length. The cup holder 2 and receiving holder 13 both have the same size inner diameter and both define a slot 23 for receiving the handle 24. The outer diameter of the cup 17 is approximately the same size as the inner diameter of the cup holder 2.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

I claim:

1. A cup holder for a support corner having an angle comprising:

a) a holding bracket attached to the corner defining at least one top insertion peg;

b) a tray having a tray top and bottom and a tray perimeter;

c) a tray bottom cylinder attached to the tray bottom removably attachable to the top insertion peg and wherein the tray perimeter further comprises a bend forming an indented portion defining an angled corner corresponding approximately to the angle of the support corner and fitting around the support corner when the tray is attached to the top insertion peg.

2. The cup holder of claim 1 wherein the tray further comprises:

a) At least one top cup holder located on the top of the tray defining a top cup holder inner perimeter and a drink container having an outside perimeter approximately equal to the top cup holder inner perimeter and removably insertable within the at least one top cup holder.

3. The cup holder of claim 1 wherein the invention further comprises at least one adapter having a first end and a second end fitting within the at least one top cup holder defining a first adapter inner perimeter which adapter inner perimeter is less than the top holder inner perimeter of the top holder.

4. The cup holder of claim 3 wherein the first adapter inner perimeter is the some as the outer perimeter of a 16 oz. standard drink can.

5. A cup holder for a support corner having an angle comprising:

a) a tray having a tray top and bottom and a tray perimeter;

b) At least one top cup holder located on the top of the tray defining a top cup holder inner perimeter and a drink container having an outside perimeter approximately equal to the top cup holder inner perimeter and removably insertable within the at least one top cup holder; and wherein the invention further comprises at least one adapter having a first end and a second end fitting within the at least one top cup holder defining a first adapter inner perimeter which adapter inner perimeter is less than the top holder inner perimeter of the top holder and wherein the at least one adapter has one first end internal perimeter at the first end and a second end internal perimeter at the second end.

6. The invention of claim 5 wherein the first end internal perimeter and second end internal perimeter is shaped differently.

7. The cup holder of claim 6 wherein the first end inside perimeter is round and the second end internal perimeter is square.

8. The cup holder of claim 6 further comprising a perimeter wall attached to the tray perimeter and extending above the tray top.

9. The cup holder of claim 6 further comprising a second perimeter wall extending above the tray top within the perimeter wall.

10. The cup holder if claim 6 wherein the holding bracket further comprises at least one bottom elastic holding means for releaseably holding the first adapter attached to the holding bracket below the at least one top insertion peg.

11. The cup holder of claim 10 wherein the bottom elastic means comprises a partially opened arc shaped arm defining an arm inner perimeter defining a partially open arc of approximately the same size and the outer perimeter of the first adapter.

12. The cup holder of claim 11 further comprising a cup having a top and a bottom with an outer perimeter which perimeter is approximately the same diameter as the adapter outer perimeter for holding a bag, said cup holder.

13. The cup holder of claim 1 further comprising a cup having a top and a bottom with an outer perimeter and wherein the top insertion peg further comprises a peg inner perimeter which is approximately the same as the cup bottom outer perimeter.

14. The cup holder of claim 1 further defined as a cup holder comprising at least one clip means for releasably holding the edge of a flat container located at the tray bottom and approximately at the tray perimeter.

15. A cup holder attachable to a surface comprising:

a) holding bracket attachable to the surface, said bracket comprising a holding means;

b) a tray having a tray top and bottom and a tray perimeter and a receiving means for being held by said holding means;

c) a cup having a perimeter and a receiving means for being held by said holding means at least one top cup holder located on the top of the tray defining a top cup holder inner perimeter and at least one adapter having a perimeter approximately equal to the perimeter of the cup and having a first end and a second end fitting within the at least one top cup holder;

d) and wherein the bracket further comprises a flexible, partially opened arc shaped arm attached to the holding means and below the holding means defining an arm inner perimeter defining a partially open arc of approximately the same size and the perimeter of the first adapter.

16. The invention of claim 15 wherein the adapter has a first internal diameter when inserted at the first end and a second internal diameter at the second end.

17. The invention of claim 15 wherein the cup further comprises a cup bottom perimeter which is the same size as the inner perimeter of the at least one cup holder.

18. The invention of claim 17 wherein the drink container has a length and further comprises a handle along the length and wherein the cup holder defines a top and a bottom and defines a slot at the top running towards the bottom for receiving the handle.

19. The cup holder of claim 15 defined as a cup holder comprising at least one clip means for holding a container with a flat edge located at the tray bottom and approximately at the tray perimeter.

* * * * *